US005333426A

United States Patent [19]

Varoglu

[11] Patent Number: 5,333,426

[45] Date of Patent: Aug. 2, 1994

[54] WOOD FRAME CONSTRUCTION SYSTEM WITH PREFABRICATED COMPONENTS

[75] Inventor: Erol Varoglu, Vancouver, Canada

[73] Assignee: Forintek Canada Corporation, Vancouver, Canada

[21] Appl. No.: 2,354

[22] Filed: Jan. 6, 1993

[51] Int. Cl.[5] ..... E04B 1/18

[52] U.S. Cl. ..... 52/236.7; 52/263; 52/264; 52/274; 52/793

[58] Field of Search ..... 52/79.1, 236.7, 264, 52/266, 793, 284, 693, 274, 279, 280, 272, 261, 262, 263, 265, 270, 234, 651.07, 653.1, 656.1

[56] References Cited

U.S. PATENT DOCUMENTS

| | | | |
|---|---|---|---|
| 681,301 | 8/1901 | Corson | 52/263 |
| 1,363,379 | 12/1920 | Wilson | 52/262 |
| 1,622,962 | 3/1927 | Michod | 52/693 |
| 2,191,804 | 2/1940 | O'Malley | 52/693 |
| 3,304,675 | 2/1967 | Wood et al. | 52/284 |
| 4,067,159 | 1/1978 | Juriss et al. | 52/234 |
| 4,074,487 | 2/1978 | Daniels et al. | 52/236.3 |
| 4,272,930 | 6/1981 | Foster | 52/79.1 |
| 4,441,286 | 4/1984 | Skvaril | 52/79.1 |
| 4,640,412 | 2/1987 | Skvaril | 206/321 |
| 5,076,310 | 12/1991 | Barenburg | 137/15 |
| 5,105,589 | 4/1992 | Rodriguez | 52/79.1 |

*Primary Examiner*—Michael Safavi

*Attorney, Agent, or Firm*—Fetherstonhaugh & Company

[57] ABSTRACT

A multi-storey wood frame construction system of the beam and column configuration uses engineered wood products. Standard prefabricated column components permit beam and column construction system which heretofore has usually only been possible with steel when used in multi-storey buildings. The system comprises a plurality of prefabricated column components, all having the seine height for one storey of construction, the components spaced apart and supporting laminated beams, each component having at least two laminated vertical column members extending from top to bottom of the component, the vertical column members spaced apart and joined at the top and at the bottom of the component by laminated horizontal members. At least two laminated angle members are included in each component, each angle member extending from the top of the component adjacent to and attached to a vertical column member, downwards and away from the vertical column member to the bottom of the component and the column components attached to the laminated beams by bolts and steel strap connections.

18 Claims, 6 Drawing Sheets 12
49
34
70
43
30
32
43
64
43
62
12
49
34
43
70
30
32
32
32
30
43
43
64
64
43
14
62
41
41
62

WOOD FRAME CONSTRUCTION SYSTEM WITH PREFABRICATED COMPONENTS

TECHNICAL FIELD

The present invention relates to multi-storey wood frame construction of buildings and the like which use a beam and column system, the columns being standard prefabricated column components.

BACKGROUND ART

At the present time a building constructed of wood generally uses standard timber sections cut to size on site and assembled. In some cases complete panel sections which may include walls, floor and/or roof are prefabricated in a shop and then brought to a building site for final construction. Engineered wood products are now becoming available on the market. These products, which include laminated veneer lumber and glue laminated dimension lumber are made in larger sections and larger lengths than standard timber, they are fabricated in a fabrication shop and may be cut to length in a shop or on site. Some examples of engineered wood products are those sold under the trade marks PARALLAM and GLULAM.

Steel buildings generally have steel beams and columns fabricated in a fabrication shop and then shipped to a building site for construction. In the past when only standard timber sections were available, the beam and column system was not suitable for multi-storey buildings primarily because wood in standard timber sections did not have the strength of steel. However, today with the new engineered wood products, multi-storey wind and earthquake resistant buildings can be constructed using wood. Furthermore, the beams and columns for such buildings can be fabricated in a fabrication shop and shipped to a building site for construction.

Prefabricated wooden buildings have been made with fabricated wall panel sections including wiring, plumbing and the like, made in a fabrication shop and shipped to a site for construction. In the past, however, this type of construction has generally been restricted to only a few storeys, generally not more than two. These restrictions have primarily been due to the length and strength of the standard timber sections available.

DISCLOSURE OF INVENTION

The present invention provides a wood frame construction system which utilizes a limited number of prefabricated column components which form structural columns for a building. The components are fabricated from engineered wood products and the frame is constructed on site from the column components and wooden beams made of engineered wood products. This enables the building to have a roof installed early in the construction stage rather than waiting until all the walls and floors are completed.

Engineered wood products are available in long lengths and eliminate the need for splices in long span beams. Throughout this text, engineered wood products are referred to as "laminated" and this definition includes all available engineered wood products as well as those that may be fabricated in the future. Thus by utilizing column components, one is able to use wood beams for longer spans than used with standard timber beams, more comparable to those used with steel construction. Furthermore, by utilizing prefabricated column components made of wood, and including steel braces to provide improved earthquake and wind resistance in the components, a column is provided that has better fire resistance than steel. Large cross-sections of wood result in better fire resistance ratings as the load carrying capacity of the system is concentrated in column components and beams that can be prefabricated to provide higher fire ratings in an economical manner. For example, use of bolts and brackets embedded in wood results in increased fire ratings.

It is an aim of the present invention to provide a wood frame construction system sufficiently flexible to respond to architectural requirements so that the columns may be located inside the walls and may provide large open spaces within a building. Furthermore, exterior walls can have large openings which has not heretofore always been possible with buildings constructed of wood.

The present invention provides a wood frame construction system comprising a plurality of prefabricated column components, all having the same height for one storey construction, the components spaced apart and supporting laminated beams; each component having at least two laminated vertical column members extending from top to bottom of the component, the vertical column members spaced apart and joined at the top and at the bottom of the component by laminated horizontal members; at least two laminated diagonal members, each extending from the top of the component adjacent to and attached to a vertical column member downwards and away from the vertical column member to the bottom of the component, and the components attached to the laminated beams by bolts and steel strap connections.

BRIEF DESCRIPTION OF DRAWINGS

In drawings which illustrate embodiments of the present invention.

BEST MODE FOR CARRYING OUT THE INVENTION

Figure 1:
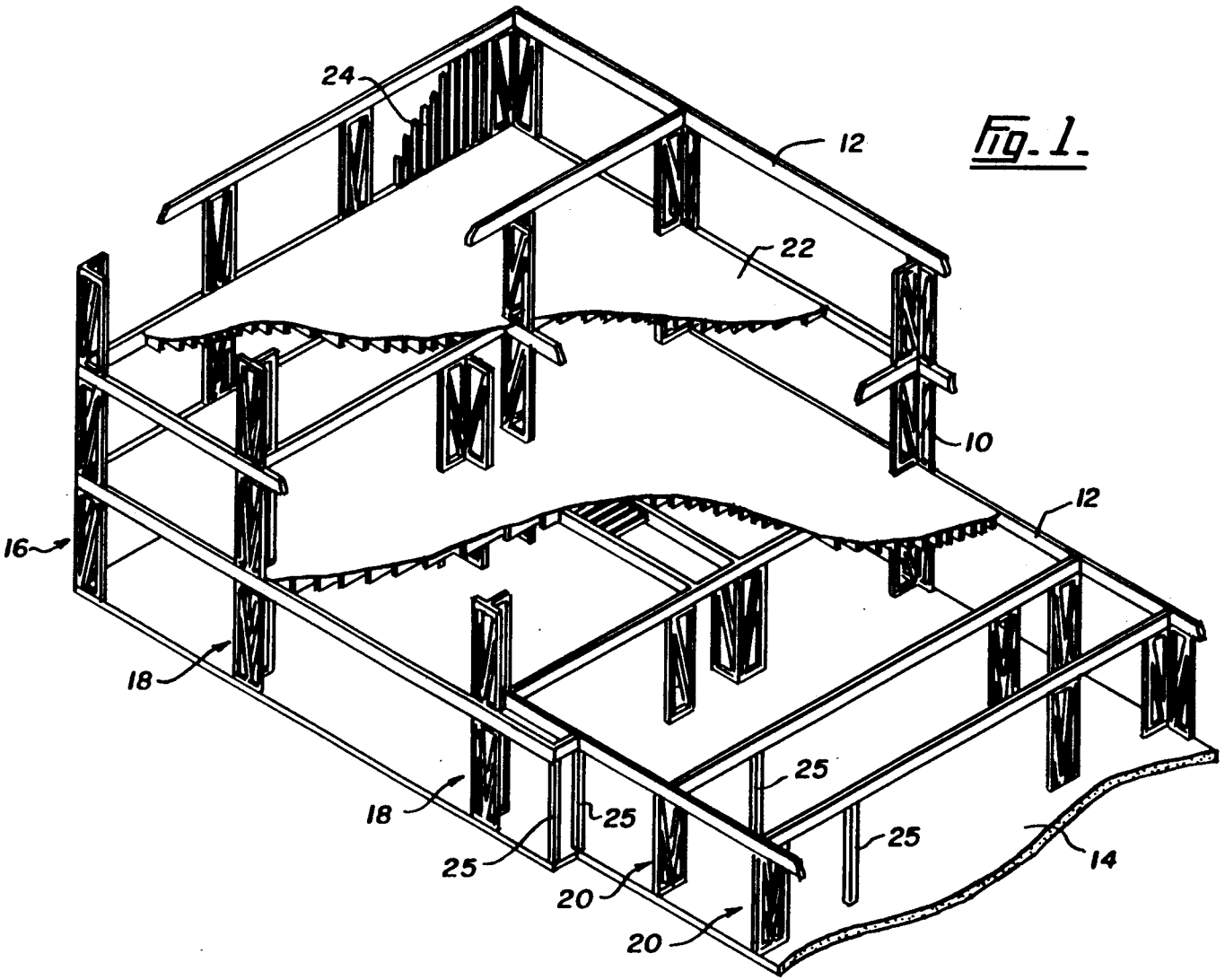
FIG. 1 is an isometric view showing a wood frame construction system according to one embodiment of the present invention.

A typical wood frame construction system is illustrated in FIG. 1 including different types of prefabricated column components 10 which in turn support laminated beams 12. A concrete base 14 is shown onto which the different types of prefabricated column components 10 are mounted. In the embodiment shown an L-shaped column component 16 is shown at the corner with two T-shaped column components 18 spaced along the front edge. Flat shaped column components 20 are also shown at appropriate positions. Each of the components 10 has exactly the same height for a single storey and mounted on top of each component is at least one horizontal beam 12. The beams 12 are arranged to span between the column components 10 and, as can be seen, a typical floor system 22 is placed on the beams 12 and also a non-load bearing wall frame 24 is placed between the column components 10. Single beam columns 25, preferably laminated, are shown at positions where less vertical load occurs. The position and type of column components 10 or columns 25 is determined by the designer.

The construction system permits the column components 10 and beams 12 to be constructed for the whole structure before the floor system 22 or non-load bearing wall frame 24 is installed. The top beams 12 can have the roof mounted thereon before the walls and flooring are installed, thus one is able to install the walls and flooring under cover.

Whereas three floors are shown with the column components 10 positioned one on top of the other, it will be apparent that many more components may be included to the desired height of structure.

Figure 2:
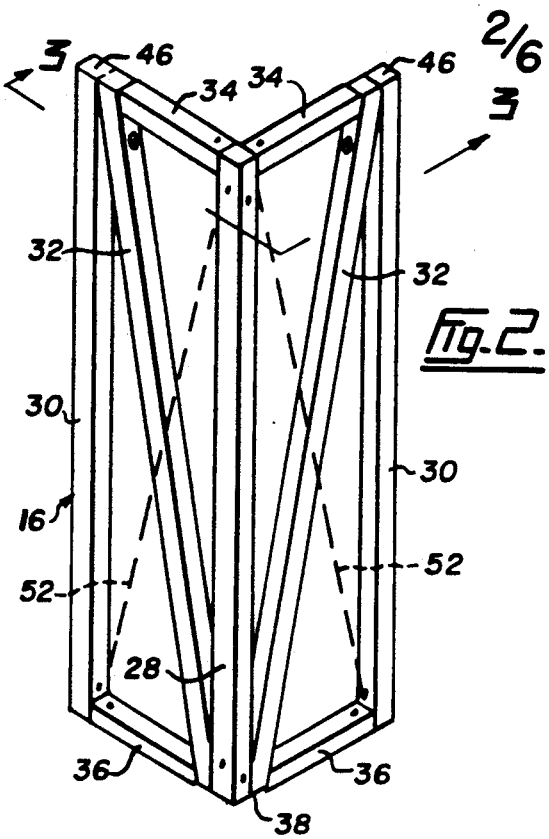
FIG. 2 is an isometric view showing an L-shaped column component for the wood frame construction system of FIG. 1.
Figure 3:
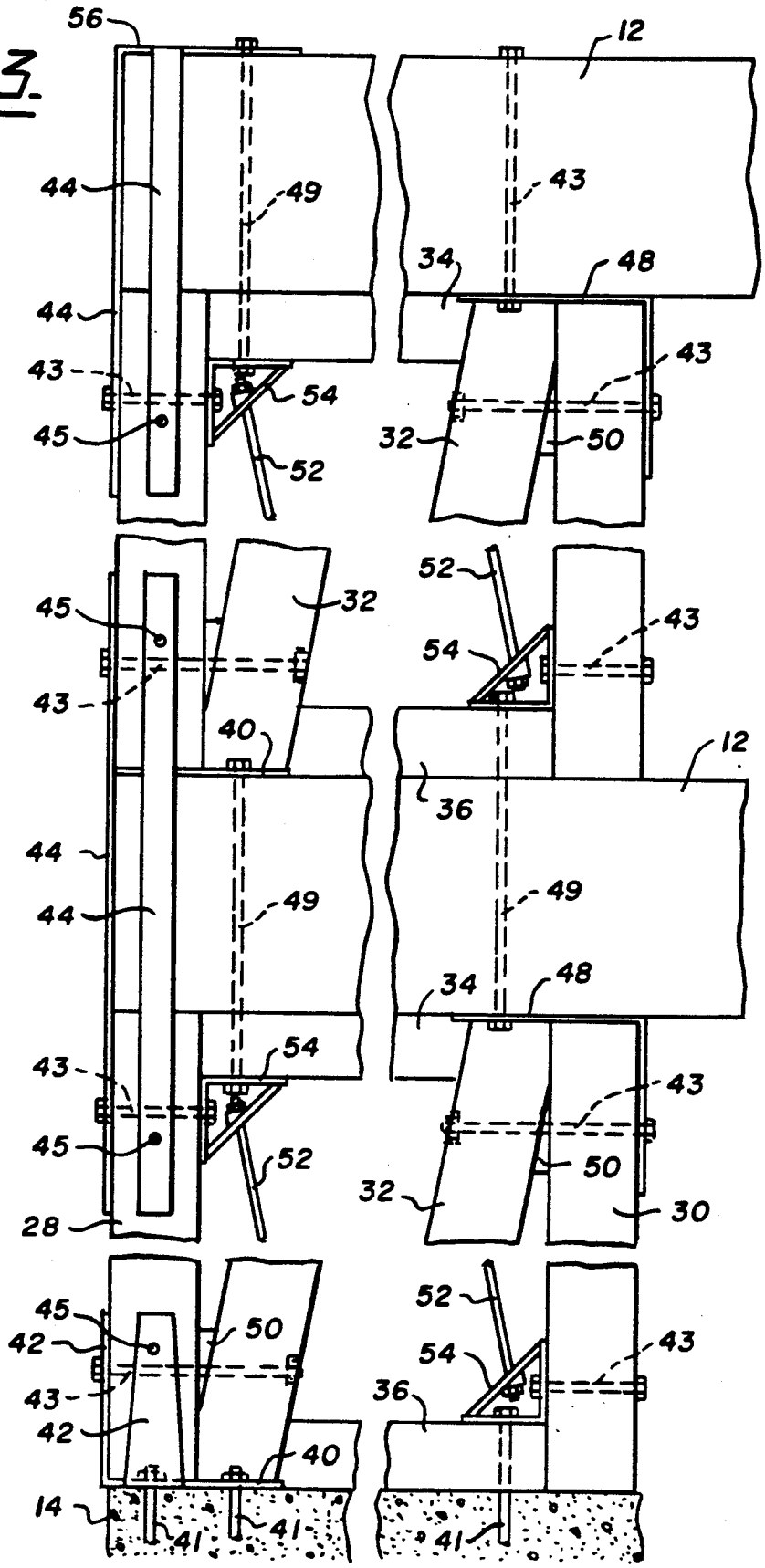
FIG. 3 is a side elevational view showing the L-shaped column component of FIG. 2.

The different types of components 10, their construction and the manner in which they are connected to the beams 12, will be illustrated hereafter. In FIG. 2 an L-shaped column component 16 is shown which has three vertical column members, a corner member 28 and two exterior members 30. These column members extend from the bottom of the component to the top for the transfer of load. Two diagonal members 32 are incorporated into the L-shaped component 16, the top of the diagonal members 32 extends up to the top of the component 16 and is positioned adjacent the exterior members 30. The bottom of the diagonal members 32 extends down to the bottom of the component 16 and is positioned adjacent the corner member 28. Top horizontal members 34 extend between the top of the corner member 28 and the top of the diagonal members 32 and similarly bottom horizontal members 36 extend between the bottom of the two exterior members 30 and the bottom of the diagonal members 32. The construction is shown in more detail in FIG. 3. A recess 38, as shown in FIG. 2, is provided underneath the corner member 28 and the two diagonal members 32. A horizontal plate 40, as shown in FIG. 3, is provided which has bolt holes for anchor bolts 41 for connection to a concrete foundation 14. For the bottom connection, two plates 42 extend up one of each of the two exterior sides of the corner member 28 and are bolted thereto with bolts 43. For the connection between the top of a L-shaped component 16 and a beam 12 and from the beam 12 to the bottom of another L-shaped component 16, two steel straps 44 are provided one on each of the two exterior sides of the corner member 28 and bolted thereto with bolts 43 as shown in FIG. 3. The steel straps 44 are attached, preferably by welding, to the plate 40 at the bottom of the corner member 28.

At the top of both the exterior members 30, and the adjoining diagonal members 32, of the L-shaped component 16 is a further recess 46, and a steel plate 48 fits therein for attachment to a laminated beam 12. Beam bolts 49 pass from the steel plate 48 through the laminated beam 12 to a steel clip 54 on the horizontal member 34 or 36. The component is joined together by bolts 43 and wood wedges 50. The bolts 43 pass through holes drilled in the members and provide increased fire protection for the component.

For earthquake protection steel braces 52 extend from the corners opposite the diagonal members 32. Each steel brace is connected by steel clips 54 bolted to the horizontal members 34 and 36 and the members 28 and 30 by bolts 43. The steel braces 52 pass through holes drilled in the center of the diagonal members 32.

The connection to the top laminated beam 12 also includes steel straps 44 joined to a top plate 56 resting on top of the beam 12. Bolts 49 pass from the top plate 56 through the laminated beam 12 and the top horizontal member 34 to a steel clip 54.

The column components are preferably assembled in a fabricating shop, the members 30,32,34 and 36 are temporarily joined together by glue, nailing or other attachment methods so they are shipped to a construction site and assembled into a structure. The bolts 43 may be in place at the time of assembly but some may be removed and replaced for attachment of the steel straps 44. In another embodiment the bolts 43 may all be added on site and bolted into place with anchor bolts 41 and beam bolts 49 at the time of construction.

The bolts 41,43,49 assist not only in holding the column components together but also form part of the structure for providing the required strength to the beam and column system. The bolts 43 hold the metal straps 44 to the components, hold the steel clips 54 in place which in turn hold the steel braces 52 to the component. Channels 64,66 and angles 70 are also held in position by the bolts 43.

All of the column components are held together by bolts 43 at the corners and the column components are held to the concrete by anchor bolts 41 and to beams by bolts 49, thus the whole structure has increased fire protection as the steel bolts are embedded in the wood. The combination of bolted column components, beams, straps and the bolted connections supplies strength to the structure.

Figure 4:
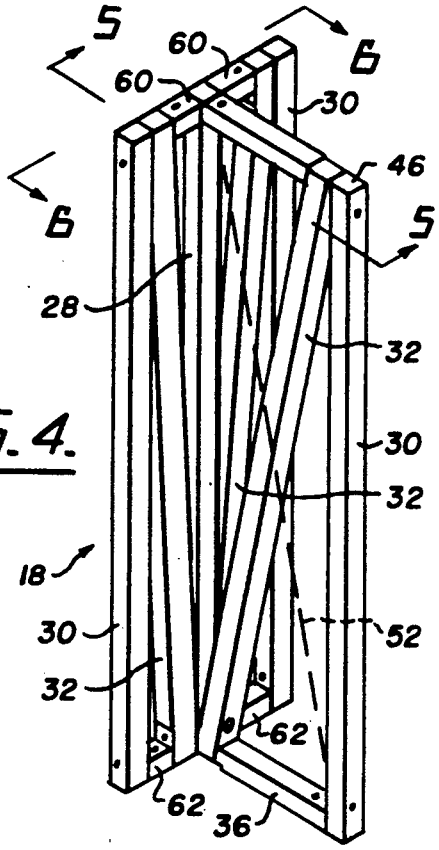
FIG. 4 is an isometric view showing a T-shaped column component for the wood frame construction system of FIG. 1.
Figure 5:
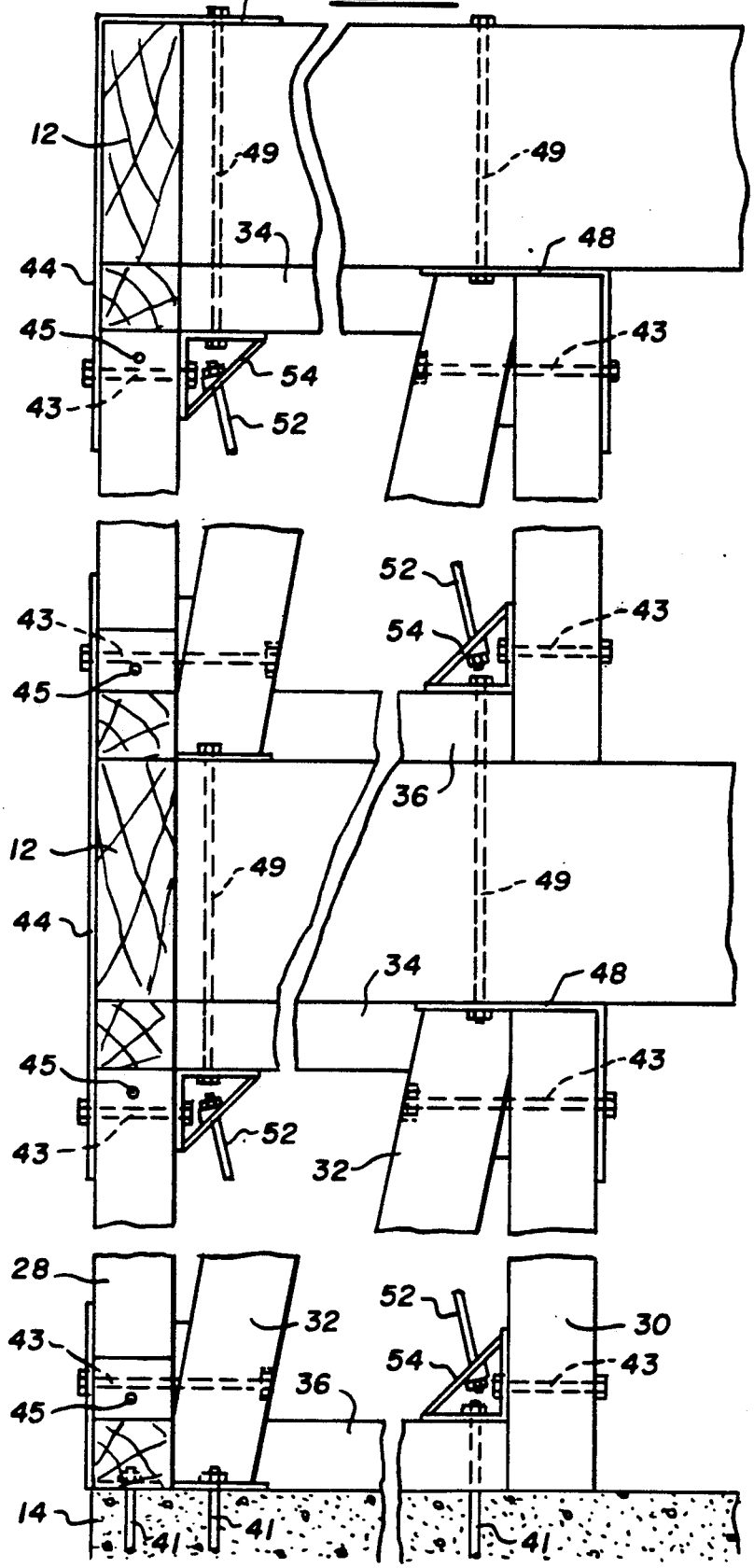
FIG. 5 is a sectional view taken at line 5—5 of FIG. 4.
Figure 6:
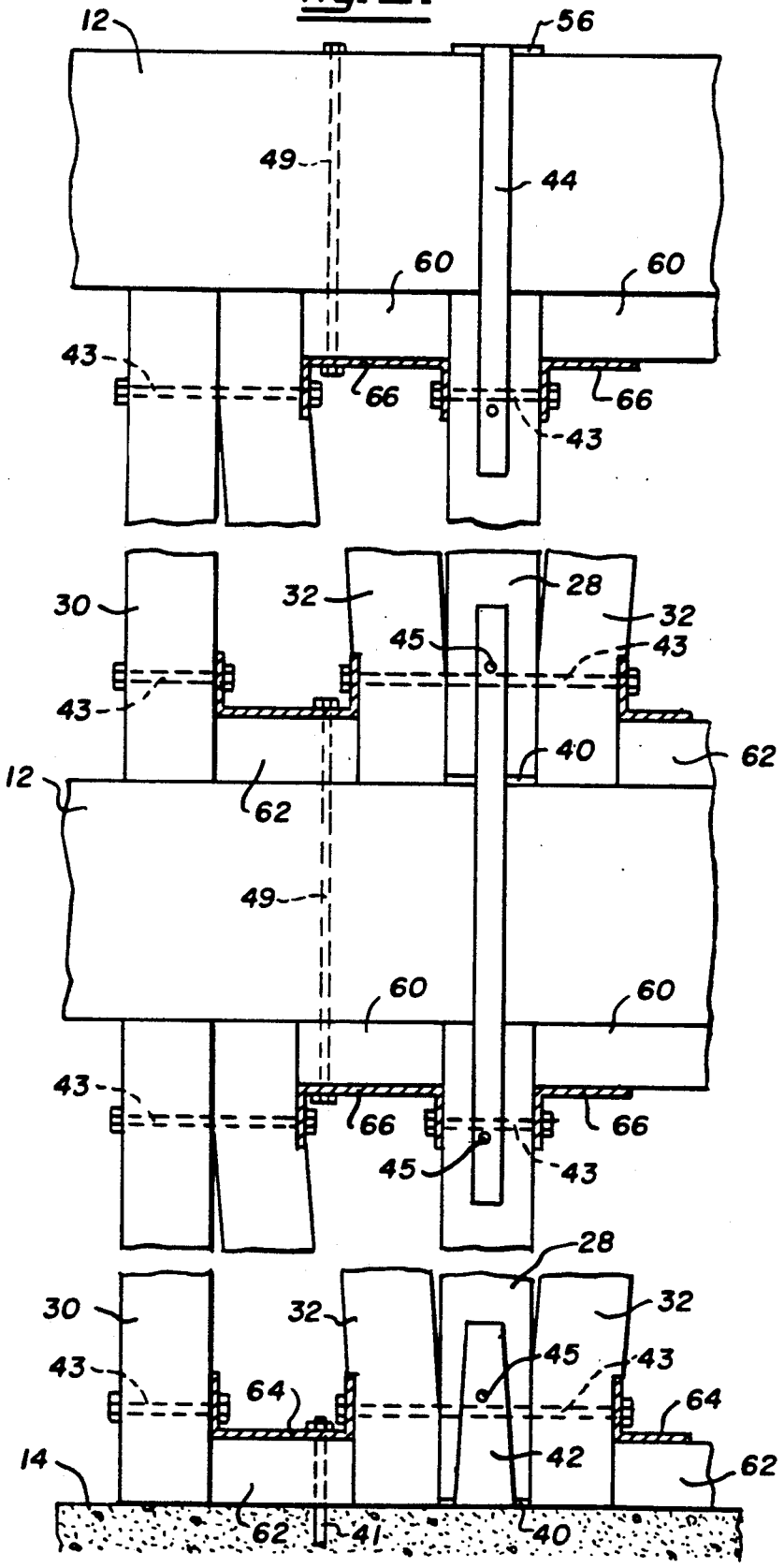
FIG. 6 is a sectional view taken at line 6—6 FIG. 4.

A T-shaped column component 18 is shown in FIG. 4 and in more detail in FIGS. 5 and 6. The component 18 has three exterior members 30 and one corner member 28. The dimensions for cross-sectional purposes are such that the width across the head of the T is substantially the same as the overall depth along the leg of the T. The corner member 28 is located where the leg of the T joins the head. Diagonal members 32 extend from the top of the T-shaped component 18 adjacent the three exterior members 30 to the bottom on the component adjacent the corner member 28. In the T-shaped head, two top horizontal members 60 are positioned between the top of the diagonal members 32 and the corner member 28 and two small bottom horizontal members 62 are placed between the exterior members 30 and the bottom of the diagonal members 32. As shown in FIG. 6 on top of the bottom horizontal members 62 are steel channels 64 bolted in place by bolts 43 and similarly on the bottom of the top horizontal members 60 are steel channels 66 bolted in place by bolts 43. The channels 64,66 strengthen the T-shaped column component 18 as shown in FIG. 5. Bolts 43 are used for joining the members in the same manner as the L-shaped column module 16 and a single steel brace 52 is provided in the leg of the T-shaped column component 18. Steel straps 42 and 44 are provided similar to that shown in FIG. 3 for the L-shaped column component 16 as is a metal plate 48 positioned in a recess 46 on the top of the exterior member 30 at the end of the leg of the T as shown in FIG. 5 and attached by bolts 43 to the members.

Figure 7:
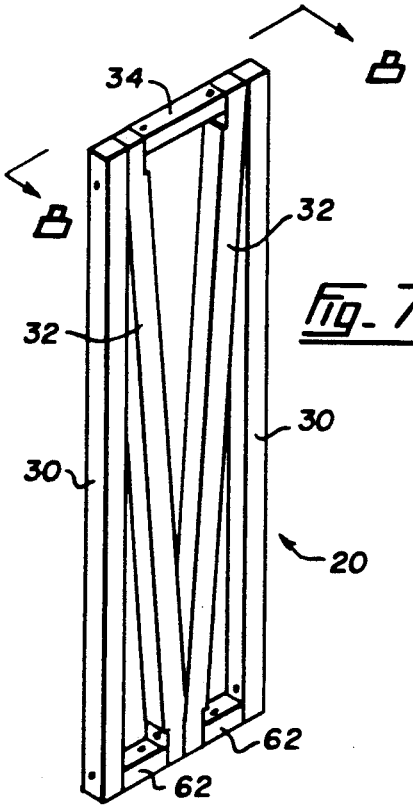
FIG. 7 is an isometric view showing a flat shaped column component suitable for the wood frame construction system of FIG. 1.
Figure 8:
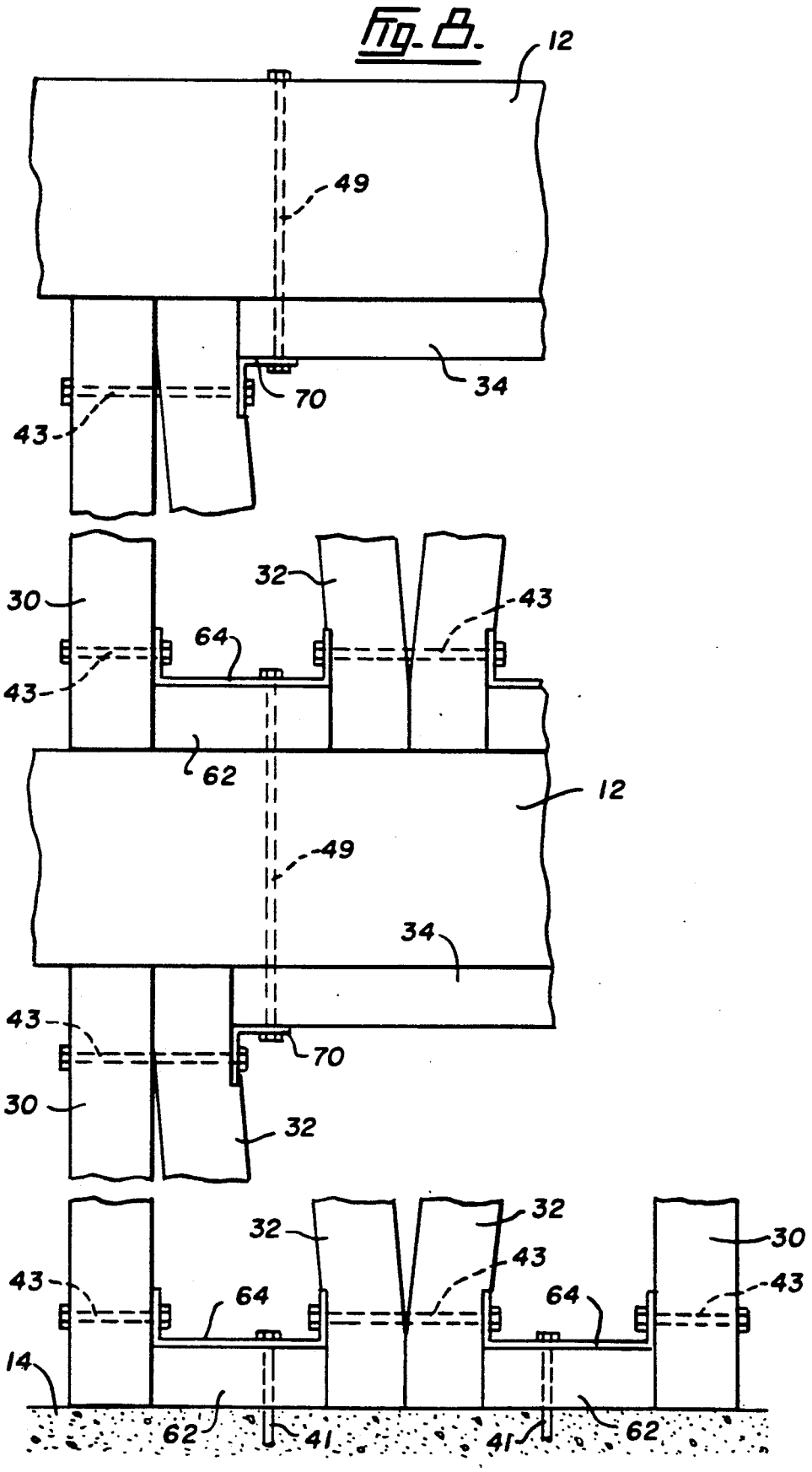
FIG. 8 is a side elevational view showing the flat shaped column component of FIG. 7.

A flat shaped column component 20 is shown in FIGS. 7 and 8. Two exterior members 30 are provided at each side of the flat shaped column component 20 with two laminated diagonal members 32 extending down from adjacent the top of the exterior members 30 to join approximately at the center of the bottom edge between the two exterior members 30. Two small horizontal bottom members 62 are positioned between the lower ends of the exterior members 30 and the diagonal members 32 with steel channels 64 on top of the bottom members 62 attached by bolts 43 for added strength. At the top of the flat shaped column component 20 a central top horizontal member 34 is positioned between the top of the two diagonal members 32. Steel angles 70 are provided at the top in the corners between the top horizontal member 34 and the diagonal members 32. Bolts 43 are used to join the flat shaped column component 20 in the same manner as the other components and bolts 49 are also used to connect the flat shaped column component 20 to laminated beams 12 at the top through the steel angles 70 and at the bottom through the steel channels 64.

Figure 9:
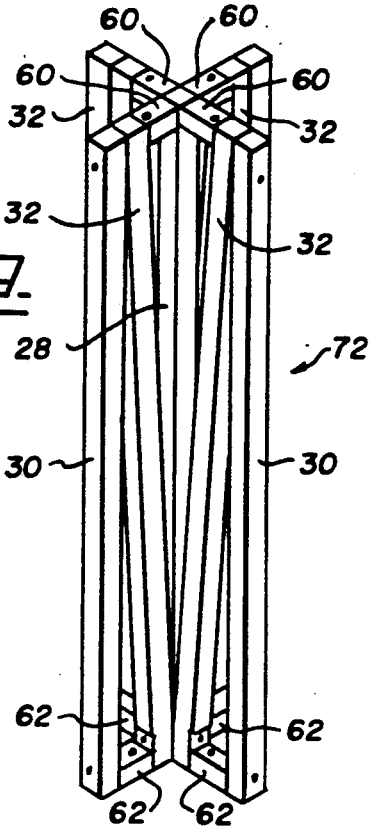
FIG. 9 is an isometric view showing an X-shaped column component suitable for the wood frame construction system of FIG. 1.

Another configuration of a column component is shown in FIG. 9. A cross shaped column component 72 has four exterior members 30 and a center member 28. Diagonal members, pets 32 extend from the top of the component 72 adjacent the exterior members 30 to the bottom on the component 72 adjacent the center member 28. Top horizontal members 60 are located between the top of the diagonal members 32 and the top of the center member 28 and bottom horizontal members 62 are located between the bottom of the exterior members 30 and the bottom of the diagonal members 32. The members are joined by bolts 43 (not shown) in the same manner as the other components. The connections for laminated beams 12 are not detailed but are substantially the same as those shown for the other column components.

The members for all the components 10 are made from wood. For standardization purposes, the exterior members 30 and center members or corner members 28 may be the same. Diagonal members 32 may be made in two forms, one for a full width such as used for the L-shaped component 16 and for the leg of the T-shaped component 18, and another for a half width such as the head of the T-shaped component 18, the flat shaped component 20 and the cross shaped component 72. Dimensions of the components vary depending upon specific requirements. However, in one example, the vertical members and diagonal members may be formed from 130 mm×152 mm cross-section laminated wood. The components themselves all have the same overall sizes, namely 1200 mm×1200 mm for the L-shaped column component, the T-shaped column component and the X-shaped column component and a 1200 mm width for the flat shaped column component. 1200 mm can be considered a standard width for the column components in one embodiment. The heights can be made to different standards dependent upon the required elevations in the structure. The heights of all components on one storey will be the same. Beam sizes vary depending upon spans, in one embodiment in a range of 400 mm to 500 mm deep. The horizontal members for the components are generally somewhat smaller in cross-section to the vertical members and the diagonal members. The horizontal members may be 110 mm×130 mm cross-section. Spans from 5 m to 10 m may be achieved, depending upon loading conditions. Various other changes may be made to these dimensions, again depending upon requirements. The column components are all substantially the same configuration and are used by architects for designing wood frame structures in the same manner that one would use steel for constructing a building.

Various changes may be made to the embodiments shown herein without departing from the scope of the present invention which is limited only by the following claims.

The embodiments of the present invention in which an exclusive property or privilege is claimed are defined as follows:

1. A wood frame construction system comprising:

a plurality of prefabricated column components, all having the same height for one storey of construction, the components spaced apart and supporting laminated beams;

each component having at least two laminated vertical column members extending from top to bottom of the component, the vertical column members spaced apart and joined at the top and at the bottom of the component by laminated horizontal members;

at least two laminated diagonal members, each extending from the top of the component adjacent to and attached to a vertical column member, downwards and away from the vertical column member to the bottom of the component, and the column components attached to the laminated beams by bolts and steel strap connections.

2. The wood frame construction system according to claim 1 wherein the column components are selected from the group of cross-sectional shapes consisting of L-shaped, T-shaped, cross shaped and flat shaped, all the column components having the same height for one storey of construction.

3. The wood frame construction system according to claim 1 wherein the construction system is multi-storey with prefabricated column components positioned vertically one above the other with laminated beams there between.

4. The wood frame construction system according to claim 1 wherein the column components are assembled and held together with bolts.

5. The wood frame construction system according to claim 1 wherein at least one of the prefabricated column components is L-shaped and has three vertical column members, two of the vertical column members being exterior members, and one being a corner member, two diagonal members are provided each one extending from the top of the component adjacent each of the two exterior members to the bottom of the component adjacent the corner member.

6. The wood frame construction system according to claim 5 wherein two metal tie rods are provided from the top of the component adjacent the corner member to the bottom of the component adjacent each of the exterior members.

7. The wood frame construction system according to claim 5 including steel straps extending from a lower component vertically upwards to an upper component attaching two components together with a laminated beam in between.

8. The wood frame construction system according to claim 5 including a horizontal steel plate at the bottom of the L-shaped component located under the corner member joining the bottom of the two diagonal members to the bottom of the corner member.

9. The wood frame construction system according to claim 5 including two horizontal steel plates, one on top of each of the two exterior members, joining the top of the two diagonal members to the top of the two exterior members.

10. The wood frame construction system according to claim 1 wherein at least one of the column components is a T-shaped component with four vertical column members, three of the vertical column members being exterior members and one being a corner member, three diagonal members are provided each one extending from the top of the component adjacent each of the exterior members to the bottom of the component adjacent the corner member.

11. The wood frame construction system according to claim 10 wherein one metal tie rod is provided extending from the top of the component adjacent the corner member to the bottom of the component adjacent the exterior member located at an end of a leg of the T-shaped component.

12. The wood frame construction system according to claim 10 including steel straps extending from a lower component, vertically upwards to an upper component attaching two components together with a laminated beam in between.

13. The wood frame construction system according to claim 10 including a horizontal steel plate at the bottom of the component under the corner member.

14. The wood frame construction system according to claim 10 including a horizontal steel plate on the top of the component above the exterior member located at an end of a leg of the T-shaped component.

15. The wood frame construction system according to claim 1 wherein at least one of the column components is a flat shaped and has two vertical column members and two diagonal members, each diagonal member extending down from the top of the component adjacent the top of each vertical column member to join at the bottom of the component substantially midway between the two vertical column members.

16. The wood frame construction system according to claim 15 including two steel angle sections at the top of the component, each angle section positioned between each of the two diagonal members and an upper horizontal member, and two steel channel sections, one between each of the two vertical column members and the two diagonal members at the bottom of the component positioned on a lower horizontal member.

17. The wood frame construction system according to claim 1 wherein at least one of the column components is X-shaped and has five vertical column members, four of the vertical column members being exterior members and one being a center member, four diagonal members are provided, each diagonal member extending down from the top of the component adjacent each of the four exterior members to the bottom of the component adjacent the center member.

18. The wood frame construction system according to claim 17 including steel straps extending from a lower component vertically upwards to an upper component attaching two components together with a laminated beam in between.

* * * * *